US006298577B1

(12) United States Patent
Haynie

(10) Patent No.: US 6,298,577 B1
(45) Date of Patent: Oct. 9, 2001

(54) DEVICE FOR ENHANCING REMOVAL OF LIQUID FROM FABRIC

(75) Inventor: Dan Haynie, North Logan, UT (US)

(73) Assignee: Concept Cleaning Systems, Inc., Logan, UT (US)

( * ) Notice: Subject to any disclaimer, the term of this patent is extended or adjusted under 35 U.S.C. 154(b) by 0 days.

(21) Appl. No.: 09/356,782

(22) Filed: Jul. 19, 1999

(51) Int. Cl.[7] ..... F26B 21/06

(52) U.S. Cl. ..... 34/84; 34/85; 34/95.1; 34/633; 34/635; 34/638; 34/229

(58) Field of Search ..... 34/443, 444, 448, 34/84, 85, 95.1, 618, 623, 633, 635, 638, 229, 92

(56) References Cited

U.S. PATENT DOCUMENTS

| | | | | |
|---|---|---|---|---|
| 3,375,540 | | 4/1968 | Hyde . | |
| 3,619,848 | | 11/1971 | Salzmann . | |
| 3,624,668 | | 11/1971 | Krause . | |
| 3,697,771 | | 10/1972 | Colt . | |
| 3,701,343 | | 10/1972 | Bowers . | |
| 3,708,824 | * | 1/1973 | Holubinka | 15/397 |
| 3,964,925 | * | 6/1976 | Burgoon | 134/21 |
| 4,000,538 | | 1/1977 | Tissier . | |
| 4,013,039 | | 3/1977 | Kubilius et al. . | |
| 4,095,309 | * | 6/1978 | Sundheim | 15/320 |
| 4,182,001 | | 1/1980 | Krause . | |
| 4,264,999 | | 5/1981 | Monson . | |
| 4,308,636 | | 1/1982 | Davis . | |
| 4,339,840 | | 7/1982 | Monson . | |
| 4,345,996 | | 8/1982 | Lindman et al. . | |
| 4,441,229 | | 4/1984 | Monson . | |
| 4,675,935 | | 6/1987 | Kasper et al. . | |
| 4,692,959 | | 9/1987 | Monson . | |
| 4,862,551 | | 9/1989 | Martinez et al. . | |
| 4,922,572 | | 5/1990 | Kohl et al. . | |
| 4,945,939 | | 8/1990 | Maxwell et al. . | |
| 4,968,166 | | 11/1990 | Ingram . | |
| 5,213,263 | | 5/1993 | Corona . | |
| 5,463,791 | | 11/1995 | Roden . | |
| 5,548,905 | * | 8/1996 | Kuma et al. | 34/92 |
| 5,555,595 | | 9/1996 | Ligman . | |
| 5,593,091 | | 1/1997 | Harris . | |
| 5,647,391 | | 7/1997 | Chan et al. . | |
| 5,655,255 | | 8/1997 | Kelly . | |
| 5,992,051 | * | 11/1999 | Salehibakhsh | 34/638 |

* cited by examiner

*Primary Examiner*—Pamela Wilson

(57) ABSTRACT

A device for enhancing removal of liquid from fabric utilizing mechanical and aerodynamic techniques. A base plate contains one or more apertures to which a vacuum is applied for extracting water from the fabric. The total cross-sectional area of the apertures is selected to be that which will increase, and preferably maximize, the extraction power for the vacuum motor with which said base plate is to be utilized. The number and shape of the apertures is selected to reduce the ratio of the total distance along all the perimeters of said apertures to the total cross-sectional area of said apertures in order to reduce boundary layer drag. The cross-sectional area of each of said apertures is selected to be large enough to permit solid contaminants that can be expected to be in the liquid to pass through said apertures without clogging said apertures. Barriers are attached to the bottom of the base plate to force any liquid in the fabric toward the apertures as the base plate is moved across the fabric. And the construction of the barriers is such that each barrier has only a small surface area that will contact the fabric generally perpendicularly to the original orientation of such fabric. This last factor combines with the fact that apertures exist in the base plate, to increase the pressure created when a given force is applied to the Extraction Device and, therefore, to increase the penetration of the base plate of the Extraction Device into a fabric.

29 Claims, 2 Drawing Sheets

DEVICE FOR ENHANCING REMOVAL OF LIQUID FROM FABRIC

BACKGROUND OF THE INVENTION

1. Field of the Invention

This invention relates to a device for increasing the efficiency of a carpet-cleaning machine and other extraction machines in removing cleaning solution and other liquids from fabric, especially a carpet.

2. Description of the Related Art

Carpet-cleaning machines spray a cleaning solution onto a fabric carpet and then vacuum the solution from the carpet into the machine. Other extraction machines may spray a liquid onto a fabric or simply remove a pre-existing liquid from the fabric.

The inventor was unable to locate any prior art patent which dealt with increasing the volume of liquid which a carpet-cleaning or other extraction machine can remove from carpet or another fabric.

The closest invention appears to be the cleaning tool of U.S. Pat. No. 4,270,238. According to lines 33 through 44 of column 2 in that patent:

"Two continuous rows of channel bristles are mounted on the one surface of the block assembly adjacent to its front and rear edges so that the distal ends of the bristles project outwardly from the one surface of the block assembly and contact the wall or ceiling to be cleaned during the cleaning operation. "A plurality of nozzles are mounted on the one surface of the block assembly between the front and rear edges of the seembly and the adjacent rows of bristles and are used to uniformly wet all of the bristles in the rows of bristles with a cleaning fluid . . . "

Line 62 of column 2 through line 14 of column 3 further provide:

"A pair of longitudinal slots are disposed in the one surface of the block assembly and are positioned equidistant about the central, transvers axis or centerline of the block assembly and midway between the continuous rows of bristles. The inner tapered ends of the slots communicate, via the interior of the wand, with a source of vacuum which causes air to be drawn into the slots during the cleaning operation. The shape of the slots is designed so that a relatively high velocity flow of air, as compared with the velocity of the air flow in the remainder of the tool, will be drawn generally uniformly into and through the slots. This air flow causes the cleaning fluid, together with the dirt suspended therein, to be stripped from the surface of the wall or ceiling almost immediately after the cleaning fluid has been applied. The substantially instantaneous extraction or removal of the cleaning fluid prevents the evaporation or drying of the cleaning fluid on the surface and also eliminates the cause of unsightly streaking by preventing cleaning fluid from trickling or running down and across a dry portion of the wall . . . "

And lines 51 through 60 in column 6 elaborate:

". . . The design of the grooves 88 and 90, the apertures 92 and 94 and the slots 96 and 98 assures that when the vacuum source 22 is being operated, air will be drawn into and through the slots 96 and 98 and into the apertures 92 and 94 at a relatively high velocity, as compared with the velocity of the air flowing downstream of the slots. As seen in FIG. 3, the highest velocity air flow is achieved as the air passes through the apertures 92 and 94 because these apertures provide the greatest restriction to air flow in the tool 10."

Additionally, lines 25 through 28 of column 3 indicate:

"A spray nozzle may be mounted on the block assembly for spraying cleaning fluid directly onto the wall or ceiling to be cleaned prior to the use of our improved cleaning tool . . . "

But, although U.S. Pat. No. 4,270,238 recognizes that increased air velocity can be achieved by restricting flow and that this can assist in cleaning, nothing in the device of that patent forcibly directs the cleaning fluid to the apertures, the bristles would preclude a deep penetration into fabric or carpet by the tool even if the tool were intended to be used on fabric or carpet, there is no recognition of maximizing the total power of extraction for the machine, and no consideration is given to reducing boundary layer drag in the slots and apertures.

Similarly, in its concept for the suction nozzle for a vacuum, U.S. Pat. No. 2,219,802 recognizes, on lines 39 through 42 of column 2, "Inasmuch as opening 27 is smaller than opening 16, a more concentrated flow of air is obtained, which is able to remove the thread." But the nozzle is designed neither to forcibly direct a fluid into the an opening or to permit deeper penetration into carpet. Moreover, again there is no recognition of maximizing the total power of extraction for the machine, and no consideration is given to reducing boundary layer drag in the nozzle.

And even though the vacuum tool of U.S. Pat. No. 1,601,774 has apertures, they are so numerous as essentially to avoid restricting the flow of air in order to increase air speed, there is no recognition of maximizing the total power of extraction for the machine, and no consideration is given to reducing boundary layer drag in the apertures. In fact, the immense number of apertures most likely increases boundary layer drag. Furthermore, because the element containing the apertures rolls, it would not forcibly direct a fluid into the apertures. Nor is there any indication in the patent that the design of the roller facilitates deeper penetration into carpet. In fact, it would appear that penetration into the carpet is not desired because the patent, in line 5 through line 9 of column 1, asserts, "It is one of the principal objects of my invention to provide a vacuum tool which will roll easily and smoothly over a carpet, rugh or the like without pulling up its threads or nap."

The suction-cleaning implement of U.S. Pat. No. 3,708,824 has tubular projections which are intended to reach the bottom of a carpet while cleaning of the upper level of the carpet is to be achieved through apertures in the base from which the tubes extend downward. A slidable plate selects either the tubes or the apertures in the base through which to draw air. Nothing, however, suggests that the tubes, the apertures in the base, or apertures in the slidable plate restrict air flow and thereby increase velocity, there is no recognition of maximizing the total power of extraction for the machine, and no consideration is given to reducing boundary layer drag. Moreover, there is no indication that the tubes increase pressure that can be exerted by the implement in order to achieve deeper penetration. It appears that such penetration is accomplished solely through the vertical extension provided by the tubes because the only reference (lines 34 through 35 of column 4) to the means of penetration by the tubes (which are called "teeth") indicates that they "provide combing action . . . "

And the apertures of plate 15 in U.S. Pat. No. 1,016,435 merely equalize pressure (See, e.g., lines 44 through 51 in the left column on page 4). The grill 104 for the suction device in U.S. Pat. No. 4,391,017 is, according to lines 35 through 27 of column 4, ". . . to prevent the device from becoming clogged by solid debris and thus reducing its effectiveness." And the circular or oval chambers in the adapter plate for the nozzle of U.S. Pat. No. 4,677,705 create rotary air currents to facilitate the removal of dust particles from carpets. There is no indication that the inventions of any of these patents restricts air flow to affect speed, there is no recognition of maximizing the total power of extraction for the machine, no consideration is given to reducing boundary layer drag. Additionally, nothing suggests this invention could forcibly direct a liquid into a nozzle or aperture or aid a nozzle to penetrate into a carpet. In fact, lines 27 through 30 and 32 through 33 of column 2 in U.S. Pat. No. 4,677,705 state, "The exterior surface of the adapter plate is smooth and slides easily over each surface to be cleaned, irrespectively of how rough the latter is . . . The adapter plate is not pulled by suction into the pile of a carpet . . . "

SUMMARY OF THE INVENTION

The present invention is a device for attachment to the bottom of a wand or other nozzle that is used to vacuum liquid, especially liquid cleaning solution, from fabric, such as a carpet.

Two mechanical concepts and two aerodynamic techniques have been employed to enhance the extraction of the liquid from the fabric.

First concerning the mechanical concepts, barriers are attached to the portion of the Enhancement Device that will contact the fabric so that such barriers, when force is applied to the Enhancement Device will extend farther into the fabric than any other portion of the Enhancement Device. These barriers can be oriented and shaped in any fashion that will push any liquid in the fabric toward extraction nozzles as the Enhancement Device is moved across the fabric, in a manner similar to the way that a snow plow pushes snow ahead and to the side of the plow.

Second concerning the mechanical concepts, since pressure is equal to force divided by the component of surface area that applies such force and that is perpendicular to the body to which force is applied, the pressure exerted by the Enhancement Device upon fabric is increased by decreasing the surface area of the enhancement Device that contacts the fabric.

The extraction nozzles are apertures in the only portion of the Enhancement Device, other than the barriers, that will, when the Enhancement Device is used, face and contact the fabric and are generally located between the barriers. The existence of such apertures, therefore, decreases the surface area of the Enhancement Device that will contact the fabric.

The fact that, when force is applied to the Enhancement Device, the barriers extend farther into the fabric than any other portion of the Enhancement Device is also employed to further increase the pressure that the Enhancement Device exerts, for a given force, against the fabric since such barriers are constructed to have only a small surface area which contacts the fabric generally perpendicularly to the original orientation of such fabric.

Thus, the existence of the apertures and the construction of the barriers combine to increase the pressure that is exerted against a fabric when a given force is applied to the Extraction Device and, therefore, to increase the penetration of the Extraction Device into the fabric. Such increased penetration enhances the removal of any liquid in the fabric.

The first aerodynamic technique is adjusting the total cross-sectional area of the extraction nozzles to increase, and preferably maximize, the mass of air that moves through the extraction nozzles per unit time. The total power of extraction produced by a vacuum motor varies with air speed and is maximized at the point where the curves plotted (versus air speed) for pressure, which decreases with increasing air speed, and for volume of air, which increases with increasing air speed, cross. Since, in accordance with the Bernoulli principle, air speed varies inversely with the cross-sectional area through which a fluid can flow, the maximum extraction power for a given vacuum motor can be achieved by selecting the appropriate total cross-sectional area of the extraction nozzles; and, logically, such extraction power increases the closer such total cross-sectional area approaches to the appropriate quantity.

The second aerodynamic technique is reducing, and preferably minimizing, the boundary layer drag in the extraction nozzles. This is accomplished by reducing, and preferably minimizing, the ratio of the total distance along the perimeters of the extraction nozzles to the total cross-sectional area of the extraction nozzles, which, consequentially, minimizes the surface of the extraction nozzles to which the stream of air is exposed.

Finally, the cross-sectional area of each of the extraction nozzles is selected to be large enough to permit solid contaminants that can be expected to be in the liquid to pass through the extraction nozzles without clogging such nozzles.

DESCRIPTION OF THE PREFERRED EMBODIMENT

The Device for Enhancing Removal of Liquid from Fabric can be constructed initially in a carpet-cleaning machine or other machine for extracting liquid from a fabric; alternatively, it can be attached to existing such machines.

The primary structure of the Enhancement Device is a base plate 1 having one or more apertures 2 which serve as extraction nozzles to remove liquid from a fabric when the Enhancement device has been built into or retrofitted on a vacuum machine, such as a carpet-cleaning machine.

Barriers 3 are attached to the bottom 4 of the base plate 1, which is the portion of the base plate 1 that will face and contact the fabric, and are preferably an integral part of the base plate 1. As discussed above, these barriers 3 can be oriented and shaped in any fashion that will force any liquid in the fabric toward the apertures 2 as the base plate 1 is moved across the fabric. For a machine that will generally be moved straight forward and straight reverse across a carpet, the barriers 3, as viewed from below, preferably have a straight, elongated shape, as illustrated in FIG. 1.

Figure 1:
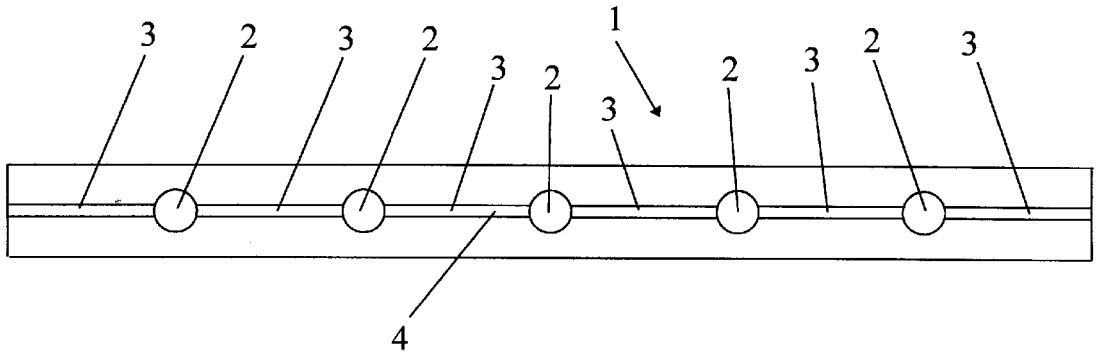
FIG. 1 shows the bottom of the base plate for the Enhancement Device.

The barriers 3 are preferably generally located between apertures 2, preferably between adjacent apertures 2, as depicted in FIG. 1.

The liquid tends to go laterally rather than further into the fabric for two reasons: (1) the fabric is denser under the barriers 3 because the barriers 3 are, in use, pressed against the fabric and (2) a vacuum is applied through the apertures 2.

Figure 2:
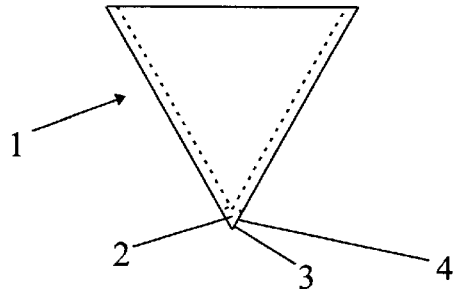
FIG. 2 depicts a preferred shape for the base plate and a barrier as viewed from either end.
Figure 3:
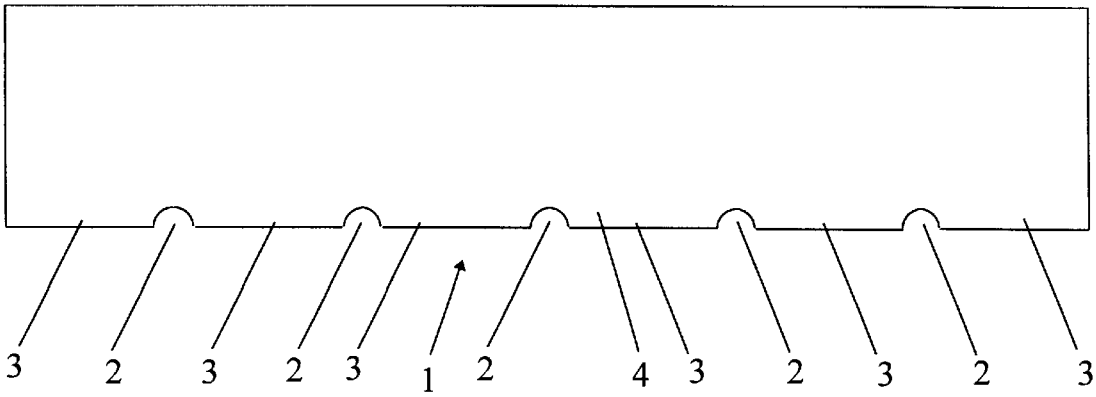
FIG. 3 illustrates the preferred shape for the base plate and barrier as seen either from in front or behind.

The construction of the barriers 3 is such that each barrier 3 has only a small surface area that will contact the fabric generally perpendicularly to the original orientation of such fabric. A preferred shape for a barrier 3, as viewed from either end of the barrier 3, to be used with a machine that will generally be moved straight forward and straight reverse across a fabric is a V shape which is preferably integrally formed in the base plate 1, which is also preferably V shaped when viewed from either end, as shown in FIG. 2. The view of this preferred shape for the barrier 3 and the base plate 1 from either in front of the base plate 1 or behind the base plate 1 is given in FIG. 3.

Figure 4:
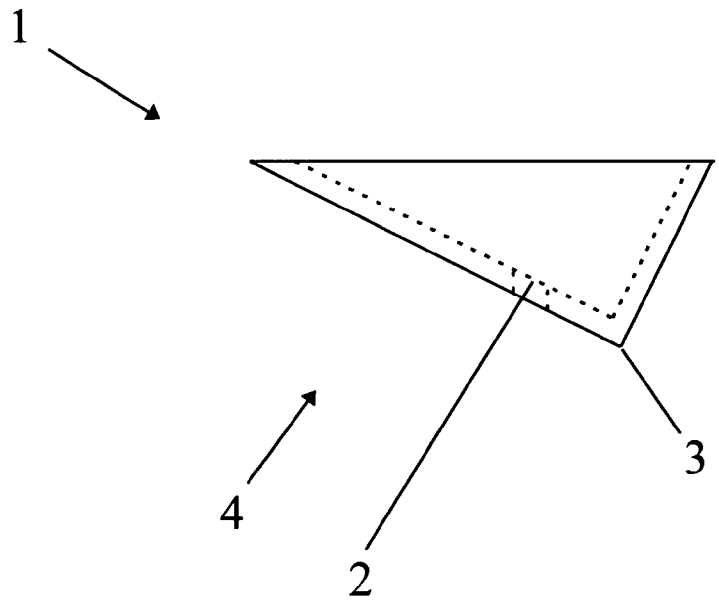
FIG. 4 portrays an optional embodiment having the barrier behind the aperture.

Optionally, the barriers 3 can be located behind the apertures 2, as portrayed in FIG. 4. In such a case, a single barrier 3 preferably runs behind all the apertures 2. Having a barrier 3 located behind the apertures 2, with respect to the intended direction of movement for the base plate 1, tends further to increase the probability that liquid will be drawn into the apertures 2 because an aperture 2 will not simply pass over the liquid; by the barrier 3 forcing the liquid to move with the aperture 2 as part of the process of forcing the liquid toward such aperture 2 the liquid will be retained for a longer period of time under the aperture 2 to which a vacuum is being applied.

Figure 5:
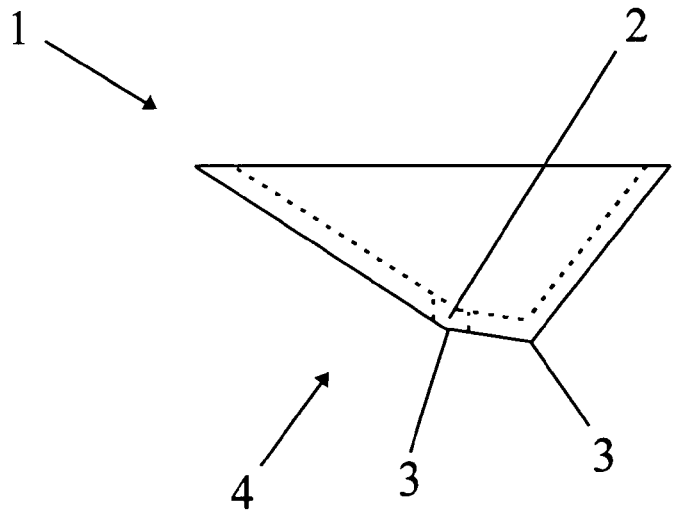
FIG. 5 combines the embodiments of FIG. 1 and FIG. 4 so that barriers are located both generally between the apertures and behind the apertures.

A further optional embodiment, which is illustrated in FIG. 5, has barriers 3 both generally between the apertures 2 and also behind the apertures 2.

As discussed above, the existence of the apertures 2; the fact that, when force is applied to the Enhancement Device, the barriers 3 extend farther into the fabric than any other portion of the Enhancement Device; and the construction of such barriers 3 to have only a small surface area which contacts the fabric generally perpendicularly to the original orientation of such fabric combine to decrease the surface areas of the Enhancement Device that will exert pressure on the fabric, i.e., the barriers 3 and the base plate 1, and thereby to increase the pressure and, consequently, the penetration of the barriers 3 and the base plate 1 achieved when a given force is applied to the Extraction Device. Such increased penetration of the base plate 1 enhances the removal of any liquid in the fabric.

The total cross-sectional area of the apertures 2 is selected to be that which, as explained above, increases, and preferably maximizes, the mass of air that moves through such apertures 2; this is accomplished by selecting the total of the aperture size for all apertures 2 combined to create the speed of air through the apertures 2 that will increase, and preferably maximize, the extraction power for the vacuum with which the Enhancement Device is to be utilized. Additionally, the number and shape of the apertures 2 is selected to reduce boundary layer drag by reducing, and preferably minimizing, the ratio of the total distance along the perimeters of the apertures 2 to the total cross sectional area of such apertures 2. This, as also explained above, minimizes the surface of the apertures 2 to which the stream of air is exposed.

Finally, again as discussed above, the cross-sectional area of the apertures 2 is selected to be large enough to permit solid contaminants that can be expected to be in the liquid to pass through the apertures 2 without clogging these apertures 2. This is consistent with the other aerodynamic goals because, e.g., the ratio of the total distance along the perimeters of the apertures 2 to the total cross-sectional area of such apertures 2, when the apertures 2 are circles, is inversely proportional to the radius of such circles.

What is claimed is:

1. A device for enhancing removal of liquid from fabric, which comprises:

a base plate having one or more apertures forming extraction nozzles; and means for forcing liquid in the fabric toward said apertures as said base plate is moved across the fabric, said means for forcing being attached to a bottom of said base plate.

2. The device for enhancing removal of liquid from fabric as recited in claim 1, wherein:

said means for forcing includes means for increasing penetration of said base plate into the fabric.

3. A device in accordance with claim 1, wherein the means for forcing includes at least one barrier disposed on the bottom of the base plate.

4. A device in accordance with claim 1, wherein the means for forcing includes a plurality of barriers, with each of the barriers disposed between adjacent apertures.

5. A device in accordance with claim 1, wherein the means for forcing includes a barrier disposed behind the plurality of apertures.

6. A device in accordance with claim 1, wherein the means for forcing includes:

a) a plurality of barriers, with each of the barriers disposed between adjacent apertures; and b) another barrier disposed behind the plurality of apertures.

7. A device in accordance with claim 1, wherein the means for forcing includes at least one barrier with a V-shaped cross section.

8. A device in accordance with claim 1, wherein the means for forcing includes at least one barrier with a V-shaped cross section; and wherein the plurality of apertures are disposed at a bottom of the V-shaped cross section.

9. A device in accordance with claim 1, wherein the baseplate has a V-shaped cross section forming at least one barrier; and wherein the plurality of apertures are disposed at a bottom of the V-shaped cross section.

10. A device configured to be attached to a machine for extracting a liquid from a fabric, the device comprising:

a) a baseplate with a bottom configured to face and contact the fabric;

b) a plurality of apertures, formed in the bottom of the baseplate, forming extraction nozzles configured to withdraw fluid from the fabric therethrough; and c) at least one barrier, disposed on the bottom of the baseplate, configured to force liquid in the fabric towards the plurality of apertures.

11. A device in accordance with claim 10, wherein the at least one barrier has a straight elongated shape.

12. A device in accordance with claim 10, wherein the at least one barrier includes a plurality of barriers, with each of the barriers disposed between adjacent apertures.

13. A device in accordance with claim 10, wherein the at least one barrier is disposed behind the plurality of apertures.

14. A device in accordance with claim 10, wherein the at least one barrier includes:

a) a plurality of barriers, with each of the barriers disposed between adjacent apertures; and b) another barrier disposed behind the plurality of apertures.

15. A device in accordance with claim 10, wherein the at least one barrier has a V-shaped cross section.

16. A device in accordance with claim 10, wherein the at least one barrier has a V-shaped cross section; and wherein the plurality of apertures are disposed at a bottom of the V-shaped cross section configured to reduce a surface area of the barriers which contacts the fabric and increase a pressure of the barriers against the fabric.

17. A device in accordance with claim 10, wherein the baseplate has a V-shaped cross section forming the at least one barrier.

18. A device in accordance with claim 10, wherein the baseplate has a V-shaped cross section forming the at least one barrier; and wherein the plurality of apertures are disposed at a bottom of the V-shaped cross section configured to reduce a surface area of the barriers which contacts the fabric and increase a pressure of the barriers against the fabric.

19. A device configured to be attached to a machine for extracting a liquid from a fabric, the device comprising:

a) a baseplate with a bottom configured to face and contact the fabric;

b) a plurality of apertures, formed in the bottom of the baseplate, forming extraction nozzles configured to withdraw fluid from the fabric therethrough; and c) a plurality of barriers, each disposed on the bottom of the baseplate between adjacent apertures, configured to force liquid in the fabric towards the plurality of apertures.

20. A device in accordance with claim 19, further comprising another barrier disposed on the bottom of the baseplate behind the plurality of apertures.

21. A device in accordance with claim 19, wherein the plurality of barriers have a V-shaped cross section.

22. A device in accordance with claim 19, wherein the plurality of barriers have a V-shaped cross section; and wherein the plurality of apertures are disposed at a bottom of the V-shaped cross section configured to reduce a surface area of the barriers which contacts the fabric and increase a pressure of the barriers against the fabric.

23. A device in accordance with claim 19, wherein the baseplate has a V-shaped cross section forming the barriers.

24. A device in accordance with claim 19, wherein the baseplate has a V-shaped cross section; and wherein the plurality of apertures are disposed at a bottom of the V-shaped cross section configured to reduce a surface area of the barriers which contacts the fabric and increase a pressure of the barriers against the fabric.

25. A device configured to be attached to a machine for extracting a liquid from a fabric, the device comprising:

a) a baseplate having a V-shaped cross section with a bottom configured to face and contact the fabric;

b) a plurality of apertures, formed in the bottom of the baseplate, forming extraction nozzles configured to withdraw fluid from the fabric therethrough; and c) the V-shaped cross section of the baseplate and the plurality of apertures forming a plurality of barriers on the bottom of the baseplate configured to force liquid in the fabric towards the plurality of apertures.

26. A device in accordance with claim 25, further comprising another barrier disposed on the baseplate behind the plurality of apertures.

27. A device in accordance with claim 25, wherein the plurality of apertures are disposed at a bottom of the V-shaped cross section configured to reduce a surface area of the barriers which contacts the fabric and increase a pressure of the barriers against the fabric.

28. A device configured to be attached to a machine for extracting a liquid from a fabric, the device comprising:

a) a baseplate with a bottom configured to face and contact the fabric;

b) a plurality of apertures, formed in the bottom of the baseplate, forming extraction nozzles configured to withdraw fluid from the fabric therethrough; and c) a barrier, disposed on the bottom of the baseplate behind the plurality of apertures, configured to force liquid in the fabric towards the plurality of apertures.

29. A device in accordance with claim 28, further comprising another plurality of barriers disposed on the bottom of the baseplate, with each of the barriers disposed between adjacent apertures.

* * * * *

US006298577C1

(12) EX PARTE REEXAMINATION CERTIFICATE (9942nd)

United States Patent

Haynie

(10) Number: US 6,298,577 C1

(45) Certificate Issued: Nov. 15, 2013

(54) DEVICE FOR ENHANCING REMOVAL OF LIQUID FROM FABRIC

(75) Inventor: Dan Haynie, North Logan, UT (US)

(73) Assignee: Harris Research, Inc., Logan, UT (US)

Reexamination Request:
No. 90/010,690, Nov. 18, 2009

Reexamination Certificate for:

| | |
|---|---|
| Patent No.: | **6,298,577** |
| Issued: | **Oct. 9, 2001** |
| Appl. No.: | **09/356,782** |
| Filed: | **Jul. 19, 1999** |

(51) Int. Cl.
*F26B 21/06* (2006.01)

(52) U.S. Cl.
USPC ..... 34/84; 34/229; 34/633; 34/635; 34/638; 34/85; 34/95.1

(58) Field of Classification Search
USPC ..... 34/84
See application file for complete search history.

(56) References Cited

To view the complete listing of prior art documents cited during the proceeding for Reexamination Control Number 90/010,690, please refer to the USPTO's public Patent Application Information Retrieval (PAIR) system under the Display References tab.

*Primary Examiner* — Sara Clarke

(57) ABSTRACT

A device for enhancing removal of liquid from fabric utilizing mechanical and aerodynamic techniques. A base plate contains one or more apertures to which a vacuum is applied for extracting water from the fabric. The total cross-sectional area of the apertures is selected to be that which will increase, and preferably maximize, the extraction power for the vacuum motor with which said base plate is to be utilized. The number and shape of the apertures is selected to reduce the ratio of the total distance along all the perimeters of said apertures to the total cross-sectional area of said apertures in order to reduce boundary layer drag. The cross-sectional area of each of said apertures is selected to be large enough to permit solid contaminants that can be expected to be in the liquid to pass through said apertures without clogging said apertures. Barriers are attached to the bottom of the base plate to force any liquid in the fabric toward the apertures as the base plate is moved across the fabric. And the construction of the barriers is such that each barrier has only a small surface area that will contact the fabric generally perpendicularly to the original orientation of such fabric. This last factor combines with the fact that apertures exist in the base plate, to increase the pressure created when a given force is applied to the Extraction Device and, therefore, to increase the penetration of the base plate of the Extraction Device into a fabric.

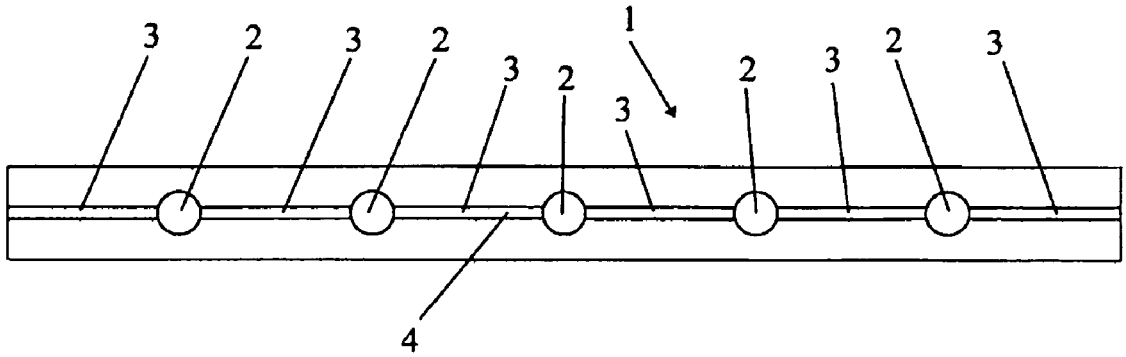

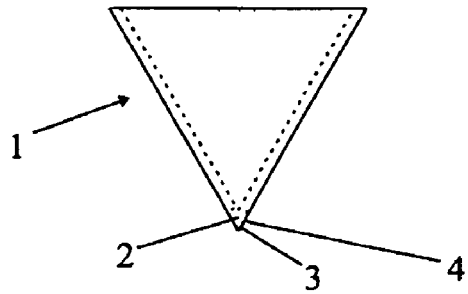

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 4, 12 and 19 is confirmed.

Claims 1-3, 5, 10, 11, 13 and 28 are cancelled.

Claims 6-9, 14-18, 20-27 and 29 were not reexamined.

* * * * *